US012467359B2

(12) United States Patent
Amorer

(10) Patent No.: US 12,467,359 B2
(45) Date of Patent: Nov. 11, 2025

(54) HYDRAULIC FRACTURING A ROCK MASS

(71) Applicant: NEWCREST MINING LIMITED, Victoria (AU)

(72) Inventor: Gabriel Jose Amorer, Victoria (AU)

(73) Assignee: NEWCREST MINING LIMITED (AU)

( * ) Notice: Subject to any disclaimer, the term of this patent is extended or adjusted under 35 U.S.C. 154(b) by 207 days.

(21) Appl. No.: 18/021,635

(22) PCT Filed: Aug. 23, 2021

(86) PCT No.: PCT/AU2021/050932
§ 371 (c)(1),
(2) Date: Feb. 16, 2023

(87) PCT Pub. No.: WO2022/036413
PCT Pub. Date: Feb. 24, 2022

(65) Prior Publication Data

US 2023/0332501 A1 Oct. 19, 2023

(30) Foreign Application Priority Data

Aug. 21, 2020 (AU) ..... 2020902989

(51) Int. Cl.
*E21C 41/16* (2006.01)
*E21C 37/12* (2006.01)

(52) U.S. Cl.
CPC ..... *E21C 37/12* (2013.01); *E21C 41/16* (2013.01)

(58) Field of Classification Search
CPC ..... E21C 37/12; E21C 41/16; E21B 43/26
See application file for complete search history.

(56) References Cited

U.S. PATENT DOCUMENTS 2,298,599 A * 10/1942 Smith ..... E21C 41/16 299/18
4,265,570 A * 5/1981 Choi ..... E21D 19/00 405/258.1

(Continued)

FOREIGN PATENT DOCUMENTS

AU 199918352 A1 10/1999
CN 104165030 11/2014

(Continued)

OTHER PUBLICATIONS

International-Type Search Report issued by the Australian Patent Office for National Patent Application No. 2020902989 dated Sep. 21, 2020 (19 pages).

(Continued)

*Primary Examiner* — Carib A Oquendo
(74) *Attorney, Agent, or Firm* — Lando & Anastasi, LLP

(57) ABSTRACT

Methods of hydraulic fracturing a rock mass as part of a method of establishing a block cave mine or extending an existing block cave mine includes (a) drilling a plurality of holes downwardly into the rock mass using drill rig equipment positioned on the ground above a proposed or existing block cave mine; and (b) injecting a hydraulic fracturing fluid into the drilled holes from above-ground hydraulic fracturing equipment and inducing fractures in the rock mass. A hydraulic fracturing equipment installation located above-ground drills a plurality of holes downwardly into the rock mass and injects a hydraulic fracturing fluid into the drilled holes and induces fractures in the rock mass. A non-metallic casing for drilled holes is also disclosed.

11 Claims, 7 Drawing Sheets

*Schematic section showing formation of fractures propogating from perfs and the resultant micro-seismic events.*

(56) References Cited

U.S. PATENT DOCUMENTS

| | | | |
|---|---|---|---|
| 5,722,490 | A | 3/1998 | Ebinger |
| 6,123,394 | A | 9/2000 | Jeffrey |
| 2007/0199695 | A1 | 8/2007 | Hocking |

FOREIGN PATENT DOCUMENTS

| | | | |
|---|---|---|---|
| CN | 105909225 | A | 8/2016 |
| EP | 0433686 | | 4/1995 |
| RU | 2280163 | | 12/2004 |
| WO | 2019205558 | A1 | 10/2019 |

OTHER PUBLICATIONS

International Search Report and Written Opinion issued by the Australian Patent Office acting as International Searching Authority for International Patent Application No. PCT/AU2021/050932 dated Dec. 7, 2021 (15 pages).

Peter K. Kaiser et al., "Hydraulic Fracturing Mine Back Trials—Design Rationale and Project Status," International Conference for Effective and Sustainable Hydraulic Fracturing, May 20-22, Brisbane, Australia, 2013.

* cited by examiner

*Drillhole RE trajectory - final survey*

*Section showing Perf & Plug tool lowered into drillhole*

*Perforations created by firing shaped charges*

*Raising perf gun 4m to fire next set of perforations*

*Perforation sets created by firing charges at 4m spacing, ready for pumping stage.*

*Schematic section showing formation of fractures propogating from perfs and the resultant micro-seismic events.*

*Bio-balls sealing off first frac allowing pressure to propogate fractures at second set of perfs.*

HYDRAULIC FRACTURING A ROCK MASS

CROSS REFERENCES TO RELATED APPLICATIONS

This application is a national-stage application under 35 U.S.C. § 371 of International Application No. PCT/AU2021/050932, filed Aug. 23, 2021, which International Application claims benefit of priority to Australian Patent Application No. 2020902989, filed Aug. 21, 2020.

TECHNICAL FIELD

The present invention relates generally to hydraulic fracturing a rock mass as part of a method of establishing a block cave mine or extending an existing block cave.

The present invention relates particularly to hydraulic fracturing a rock mass by drilling a plurality of holes downwardly into the rock mass using a drill rig positioned on the ground above a proposed or existing block cave mine and then injecting a hydraulic fracturing fluid into the drilled holes from above-ground equipment as part of a method of establishing a block cave mine or extending an existing block cave mine.

The present invention also relates to a non-metallic casing for lining the drilled holes.

BACKGROUND

Block cave mining is an efficient technique that leverages gravity and induced stress to support the efficient extraction of ore from a rock mass.

Block cave mining methods, due to their low operating costs and high productivity, have historically been the preferred underground solution to profitably mine large, low-grade deposits.

Major drawbacks of block cave mining are high upfront mine establishment costs and long lead times to establish name plate production rates. Establishment costs typically range from US$2 billion to US$5 billion and take up to 7 years to reach production.

Establishment costs and times are exacerbated by increasingly complex ore bodies at depth, including depth related issues such as strength/stress ratios, material handling costs, seismicity, heat, etc.

Conventional block caves are established from two levels, namely an undercut level which functions to facilitate the creation of a void above a draw horizon to induce caving within the mine, and a lower extraction level from which draw bells are opened upwardly and connected to the undercut level, allowing caved ore to move downwardly through the draw bells into the extraction level and be removed from the extraction level.

Establishment of conventional block caves or extending existing block cave mines includes pre-conditioning a rock mass above the undercut and extraction levels of the mine.

Papers by Catalan et al., 2012a, Catalan et al., 2012b, Catalan et al., 2012c and Catalan (2015) define "pre-conditioning" a rock mass as the implementation of processes to modify the rock mass to enable better control or management of a block cave mine.

The term "modify" is used in this context to mean causing artificially induced changes to a rock mass through:

(a) hydraulic fracturing of the rock mass, and/or (b) large-scale confined blasting of the rock mass.

Conventional hydraulic fracturing a rock mass comprises drilling a plurality of holes into the rock mass from sub-levels below the ground and injecting a hydraulic fracturing fluid into the drilled holes and forming fractures in the rock mass that extend from the drilled holes. The fractures facilitate rock mass failure that assists in downward movement of rock mass during caving and reduce unwanted energy transfer through the rock mass as a consequence of seismic activity.

As used herein, the term "hydraulic fracturing" (also known as "hydrofracturing" or "fracking") is understood to mean fracturing a rock mass by a pressurized fluid, such as water, that is injected into drilled holes extending into the rock mass.

The present invention provides an alternative method of hydraulic fracturing a rock mass as a part of the establishment of a block cave or extending an existing block cave mine and an installation for carrying out the method.

The present invention also provides a non-metallic casing for lining drilled holes formed in the method.

The above description is not an admission of the common general knowledge in Australia or elsewhere.

SUMMARY

The invention is based on a realisation that hydraulic fracturing a rock mass from the ground above the rock mass is an effective alternative to conventional hydraulic fracturing technology for establishing a block cave mine or extending an existing block cave mine.

The invention includes:

(a) a method of hydraulic fracturing a rock mass;

(b) a hydraulic fracturing equipment installation for carrying out the method;

(c) a block cave mine that includes an above-ground hydraulic fracturing equipment installation at a block cave mine establishment stage or a mine extension stage of an existing block cave mine;

(d) a non-metallic casing and coupling for use in lining drilled holes formed as part of the hydraulic fracturing method; and (e) a method of manufacturing the non-metallic casing.

Hydraulic Fracturing Method

In broad terms, the invention provides a method of hydraulic fracturing a rock mass as part of a method of establishing a block cave mine or extending an existing block cave mine that includes:

(a) drilling a plurality of holes downwardly into the rock mass using a drill rig equipment positioned on the ground above a proposed or existing block cave mine (referred to below as stage 1); and (b) injecting a hydraulic fracturing fluid into the drilled holes from above-ground hydraulic fracturing equipment and inducing fractures in the rock mass (referred to below as stage 2).

The fractures in the rock mass that are induced by the hydraulic fracturing method assist subsequent removal of the rock mass via the extraction level of the block cave mine.

The fractures in the rock mass that are induced by the hydraulic fracturing method also assist making the rock formation more seismic-safe by reducing the transfer of energy through the rock mass in a seismic event.

Hydraulic fracturing fluid injection step (b) may include perforating each hole so that injected hydraulic fracturing fluid flows through perforations into the rock mass and induces fractures in the rock mass.

Drilling step (a) may include casing each hole.

Drilling step (a) may include casing and lining each hole.

Hydraulic fracturing fluid injection step (b) may include perforating each cased and lined hole so that injected hydraulic fracturing fluid flows through the perforations into the rock mass and induces fractures in the rock mass.

The cased and lined hole may be perforated by any suitable perforating apparatus.

One example of a suitable perforating apparatus is a perforating gun having spaced explosive charges that can be initiated to from a perforate the immediate part of the cased and lined hole.

In addition, in more particular terms, the invention provides a method of hydraulic fracturing a rock mass as part of a method of establishing a block cave mine or extending an existing block cave mine that includes:

(a) drilling a plurality of spaced-apart holes downwardly into a rock mass using a drill rig positioned on the ground above a proposed or existing block cave mine;
(b) lining the drilled holes with a casing, such as with a metallic casing or a non-metallic casing;
(c) perforating the casing of each drilled hole; and
(d) injecting a hydraulic fracturing fluid into the perforated holes from above-ground equipment and forcing hydraulic fracturing fluid through perforations into the rock mass and inducing fractures in the rock mass.

Step (c) may include perforating the casing of each drilled hole at spaced intervals along a section of the drilled hole.

The perforated holes may be in "frac clusters", with multiple perforated holes at different heights forming a single cluster.

In addition, in more particular terms, the invention provides a method of hydraulic fracturing a rock mass as part of a method of establishing a block cave mine or extending an existing block cave mine that includes:

(a) drilling a first hole downwardly into the rock mass using a drill rig positioned on the ground at a location;
(b) lining the drilled hole with a casing, such as with a metallic casing or a non-metallic casing;
(c) pumping cement or any other suitable lining material down the cased hole to a lower end, i.e. toe, of the hole and then up into an annular space between a hole wall and the casing to form a lining between the hole wall and the casing;
(d) positioning a well head on the cased and lined hole that closes the hole;
(e) perforating the casing and the outer lining at spaced intervals along a section of the drilled hole with a perforating apparatus, such as a perforating gun having spaced explosive charges that is lowered down and raised from the cased and lined hole on a wireline;
(f) injecting a hydraulic fracturing fluid into the cased, lined and perforated hole via the well head and forcing hydraulic fracturing fluid through the perforations into the rock mass and inducing fractures in the rock mass; and
(g) carrying out the series of steps (a) to (f) for each of a plurality of holes.

The method may include drilling a plurality of holes at the location and forming a cluster of holes at the location and carrying out the subsequent method steps on the cluster of holes at the location.

The method may include carrying out the drilling, casing and lining method steps (i.e. stage 1 method steps) with drill rig equipment at the location and forming the cluster of cased and lined holes and then, on completion of the method steps, moving the drill rig equipment to another location and repeating the method steps at the other location.

The method may include setting up hydraulic fracturing fluid injection equipment at the location after the drill rig equipment has been moved from the location and perforating the cased and lined holes and hydraulic fracturing the cluster of holes (i.e. stage 2 method steps) and then, on completion of the method steps, moving the hydraulic fracturing fluid injection equipment to another location and repeating the stage 2 method steps at the other location.

The drilled holes may be any suitable hole diameter, hole depth(s), and hole spacing(s).

Typically, the casing is a non-metallic casing.

As is described further below, the applicant has found that forming the casing from a non-metallic material provides an opportunity to balance the operational requirements for containing high pressure injection of hydraulic fracturing fluid and minimising or avoiding damage altogether to mine crushers and other equipment after the casing is processed downstream, i.e. after the casing moves downwardly through a block cave and is removed from the extraction level of the mine.

Perforation step (e) may include perforating the casing at any suitable spaced intervals along the length of the casing.

The perforations may be any suitable size and shape.

The perforations may be in "frac clusters", with multiple perforations at each of a number of different heights forming a single cluster.

The hydraulic fracturing fluid may be any suitable hydraulic fracturing fluid.

Typically, water is the hydraulic fracturing fluid.

The invention may include selecting hydraulic fracturing fluids that are suitable for forming fractures having different sizes and shapes.

Different hydraulic fracturing fluids may be required in different situations.

One option is forming parallel fractures (preferred by miners)—slower flow rate and more viscous hydraulic fracturing fluids.

Another option is forming complex fractures (preferred by seismologists)—different hydraulic fracturing fluids and higher flow rates.

The method may include selecting parameters for the method having regard to a need to compromise between the different priorities of seismologists and mining engineers. Seismologists want to heavily fracture a rock mass—minimising energy transfer issues in a seismic event. Mining engineers do not want to heavily fracture a rock mass. Mining engineers prefer to fracture as rock mass to form comparatively larger fragments than those preferred by seismologists that will be able to move downwardly as block caving continues and be removed as reasonable-sized fragments, i.e. not fines, via draw bells. Inevitably, rock fragments that form in upper levels of a block cave mine will reduce in size due to fragment-fragment abrasion as the fragments move downwardly. Mining engineers do not want the fragments to be "fines" at the draw points.

While hydraulic fracturing technology has been previously employed during conventional block caving, it is initiated at block cave sub-levels and not from the ground. Given the logistical issues of underground operation, there is an upper limit on the lengths of casings used during conventional hydraulic fracturing—such as 1.5 m. In contrast, the method of hydraulic fracturing of the invention is not subject to the same logistical constraints because the operation is conducted above ground level. As such, significantly longer casings may be used—such as 9+m, and higher power/torque is able to be used for drilling, thereby making it possible to drill fewer holes per a given volume of rock mass compared to the number of holes required in an underground pre-conditioning operation.

Hydraulic fracturing a rock mass from the ground provides an opportunity to accelerate cave propagation, manage high rock stresses, and reduce early fragmentation size and downstream secondary breakage requirements.

Further to the above, a main purpose of hydraulic fracturing a rock mass is to fracture the rock mass to create fractures, effect a reduction in rock mass quality, reduce the modulus of elasticity of the rock mass, improve fragmentation, and reduce the capacity of the rock to transmit/convey stress.

Hydraulic fracturing assists in ensuring sufficient initiation of a block cave as it reduces the rock mass quality and reduces the critical hydraulic radius required before caving commences.

Hydraulic fracturing not only helps to degrade the rock mass strength to reduce the critical hydraulic radius required before cave initiation, it also helps to manage stress levels within the rock mass thereby reducing magnitude and frequency of mining induced seismicity.

A more broken, "softer" and elastic rock mass has less capability to convey/transmit rock stress and therefore actual stress levels encountered are generally reduced.

Hydraulic fracturing also assists in improving early fragmentation and therefore reduces the need for secondary breakage of oversized fragments during mining production activities.

Hydraulic Fracturing Equipment Installation

In broad terms, the invention also provides a hydraulic fracturing equipment installation positioned at a location on the ground above a rock mass and operable for hydraulic fracturing the rock mass as part of a method of establishing a block cave mine or extending an existing block cave mine, the installation including:

(a) drill rig equipment operable for drilling a hole downwardly into the rock mass at the location; and (b) hydraulic fracturing equipment operable, for example after the drill rig equipment has been moved away from the hole, for injecting hydraulic fracturing fluid into the hole for inducing fractures in the rock mass.

More particularly, although not by any means exclusively, the invention provides a hydraulic fracturing equipment installation positioned at a location on the ground above a rock mass and operable for hydraulic fracturing the rock mass as part of a method of establishing a block cave mine or extending an existing block cave mine, the installation including:

(a) movable drill rig equipment positioned at the location on the ground above a proposed or existing block cave mine and operable in stage 1 of the method for drilling a plurality of spaced-apart holes downwardly into the rock mass to form a cluster of holes at the location and movable to another location at the completion of stage 1; and (b) hydraulic fracturing equipment located on the ground at the location, for example after the drill rig equipment has been moved from the location, and operable for perforating the holes and injecting hydraulic fracturing fluid into the holes for inducing fractures in the rock mass in stage 2 of the method and movable to another location at the completion of stage 2.

The drill rig equipment may include equipment operable for lining the drilled holes with a casing, such as a metallic or a non-metallic casing.

The drill rig equipment may include equipment operable for forming a lining, such as of a concrete material, in an annular space between the casing and a hole wall.

Typically, the installation includes the following equipment:

Drill rig—depending on the stage of development;

Well head—positioned after drill rig is moved to another drill hole location.

Crane(s);

Frac van;

Frac pump(s);

Hole perforation equipment, such as a perforation gun assembly;

Wireline truck;

Wireline trucks for micro-seismic monitoring (if required);

Fluid storage pond(s)—hydraulic fracturing fluid 90; and

Flowback tank.

Block Cave Mine

The invention also provides a block cave mine that includes the above-described hydraulic fracturing equipment installation located on the ground above a rock mass at a block mine establishment stage or an extension stage of an existing block cave mine and operable for hydraulic fracturing the rock mass as part of a method of establishing a block cave mine or extending an existing block cave mine.

The block cave mine may be any suitable mine.

By way of example, the block cave mine may be as described and claimed in International (PCT) Patent Application No. PCT/AU2021/050255 in the name of the applicant, and the disclosure in the PCT specification is incorporated herein by cross-reference.

Non-Metallic Casing and Coupling

The invention provides a non-metallic casing for use in a hydraulic fracturing method, the non-metallic casing comprising a non-metallic material having a maximum pressure resistance of 90 MPa.

The invention provides a non-metallic casing for use in a hydraulic fracturing method of establishing a block cave mine or extending an existing block cave mine, the non-metallic casing comprising a non-metallic material.

The non-metallic material may have a maximum pressure resistance of 90 MPa.

The invention also provides a coupling for connecting together axially-aligned non-metallic casings in end-to-end relationship.

The invention also provides an assembly of two axially aligned casings connected together in end-to-end relationship via a coupling.

As used herein, the term "maximum pressure resistance" refers to the maximum pressure from a hydraulic fracturing fluid that the non-metallic casing is able to withstand without failure of the casing.

Whilst the use of strong metals such as steel may otherwise satisfy the requirement for high-pressure resistance, the applicant has realised that its use in a block cave would present significant operational complications because of downstream processing issues.

In particular, metallic casings would end up in underground crushers and on conveyor belts, resulting in causing damage to the crushers and conveyors and other equipment and potentially threaten the safety of personnel.

Accordingly, the non-metallic casing is preferably formed to withstand high internal pressures, i.e. has sufficient high-pressure resistance, during injection of hydraulic fracturing fluid and to fracture in a mine crusher without causing significant damage to the crusher.

The non-metallic casing may be made of any suitable non-metallic material that has mechanical properties that allow a plurality of the casings to be coupled together and inserted into a drilled hole and:

(a) withstand handling requirements to do this;

(b) remain intact during perforating the casings for example with a perforating gun;

(c) remain intact when bridge plugs are expanded and contact the casings, (d) withstand hydraulic fracturing fluid pressures that are required to force hydraulic fluid through perforations into the rock mass and fracture the rock mass; and (e) fracture as the block cave collapses downwardly to and through block cave draw points and when extracted block cave material, including the casings, is processed in comminution circuits without damaging the comminution apparatus.

The non-metallic casing may be a polymeric material.

The non-metallic casing may be a composite material comprising a polymeric material matrix and a reinforcement dispersed in the matrix.

The reinforcement may be in the form of fibres.

The non-metallic casing may comprise a fibre-reinforced composite material.

In one embodiment, the fibre-reinforced composite material includes glass fibres.

In another embodiment, the fibre-reinforced composite material includes carbon fibres.

In another embodiment, the fibre-reinforced composite material includes a polymeric matrix, such as an epoxy material.

Typically, the casing is elongate with a central bore that extends between open ends and has a uniform circular transverse cross-section along the casing from one open end to the other open end of the casing.

The casing may be any suitable length, any suitable diameter, and any suitable wall thickness.

The casing may be at least 6 m, typically at least 8 m, more typically at least 9 m.

The outer diameter of the casing may be at least 10 cm.

In an embodiment, the non-metallic casing includes a tapered threaded section on at least one end thereof.

The axial length of the threaded section may be any suitable length.

The tapered threaded section may extend over a longitudinal distance of greater than 5 cm, typically greater than 8 cm.

The tapered threaded section may extend over a longitudinal distance of between 5 and 25 cm, typically between 8 and 15 cm.

The tapered threaded section may taper from an outer diameter of less than 15 cm, typically less than 12 cm.

The tapered threaded section may taper at an angle of between 0.5° and 2° to the longitudinal axis of the casing.

By way of example, an outer surface of each end section of each coupling may taper inwardly towards that end of the casing and be formed with an external thread. The threaded ends sections may be coated with a material such as acetal or silicone to facilitate forming a seal with the coupling when two axially aligned casings are located in the coupling.

The coupling may include a cylindrical sleeve with open ends.

An internal surface of the sleeve may taper inwardly from the ends towards the centre, i.e. so that the internal diameter of the sleeve decreases inwardly from the ends of the sleeve towards the centres of the sleeve.

The internal surface of the sleeve may include a flat land in central section of the sleeve mid-way between the open ends of the sleeve. The purpose of the flat land is to prevent insertion of casings too far into the coupling, such that there is a small axial gap between the ends of the casings in the coupling.

In an embodiment, the non-metallic casing includes a thermoplastic liner.

The thermoplastic liner may comprise polyethylene or any other suitable thermoplastic material.

The non-metallic casing may include alternating circumferential ribs and longitudinal ribs.

The circumferential ribs provide resistance to hoop stresses in the casing.

The longitudinal ribs provide resistance to longitudinal stresses in the casing.

Method of Manufacturing the Non-Metallic Casing

The invention also provides a method of manufacturing the non-metallic casing described above, the method including forming a casing from a non-metallic material and forming a threaded coupling on at least one end of the casing.

Benefits of the Invention

A benefit of the invention is an opportunity to de-couple pre-conditioning a rock mass for a block cave mine from underground operations that are required to establish a block cave mine or to extend an existing block cave mine. Specifically, with the invention the hydraulic fracturing required to pre-condition a rock mass can be carried out from an above-ground installation ahead of any underground operations. This is a benefit because of the cost and time and logistical complexity associated with working underground on block cave establishment and block cave extension operations.

Another benefit of the invention is an opportunity to carry out the hydraulic fracturing method of the invention with comparatively larger and higher-powered drilling rigs and other equipment than can be used in underground pre-conditioning operations and without the constraints of using equipment underground. Therefore, there is an opportunity to complete pre-conditioning of a given rock mass with the hydraulic fracturing method and equipment installation of the invention more quickly than is possible with underground pre-conditioning operations.

Another related benefit of the invention is an opportunity to drill larger diameter and fewer holes for a given volume of rock mass than is possible with underground pre-conditioning operations arising from the opportunity to use comparatively larger and higher-powered drilling rigs and other equipment than can be used in underground pre-conditioning operations. Drilling fewer holes provides an opportunity for higher pre-conditioning rates compared to those in underground pre-conditioning operations. In addition, drilling larger holes makes it possible to form larger perforations in lined and cased holes and, therefore more extensive hydraulic fracturing of a rock mass.

Other benefits of the invention include opportunities for:

Improved caveability.

Improved cave propagation rate (relative velocity at which the cave is propagated vertically as a response to extraction).

Improved seismic response during all the stages of the caving process (improves safety for people, equipment and installations).

Improved cave fragmentation (the rock mass degrades into smaller fragments which makes the extraction process more continuous and efficient).

Improved cave growth geometry (the cave propagates along the planned ore volume which helps control dilution and undesired propagation deviation).

Minimal damage to downstream equipment such as crushers, etc. when the non-metallic casing is selected to line the drilled holes.

Comparison with Oil/Gas Industry Technology

There are similarities and differences between the hydraulic fracturing technology of the invention for use in establishing and extending block cave mines and hydraulic fracturing technology used in the oil/gas industry, including the following similarities and differences:

There are no fundamental differences in terms of hole diameter, depths, hole spacings, well-heads, and operating procedures for drilling and lining drilled holes, cementing casings in position in the holes, and perforating casings at spaced intervals along the lengths of the casings.

There is a different focus of the two industries. The mining industry wants to (a) make rock formations seismic safe (i.e. reduce transfer of energy through rock mass) and (b) fragment rock to facilitate downward movement of rock, for example in a block cave. The oil/gas industry wants to extract oil/gas from reservoirs. These differences are significant in terms of the problems solved by the applicant in making the invention. The applicant faced different problems. For example, typically, the invention will include drilling holes in hard rock. The oil/gas industry tends to drill sedimentary and other less hard formations.

It is not necessary to use proppants such as sand, etc to keep open fractures, as is the case in the oil/gas industry.

The perforation sizes may be the same of different—could be larger or smaller.

BRIEF DESCRIPTION OF THE DRAWINGS

In order that the inventions are more fully explained, embodiments of (a) a method of hydraulic fracturing a rock mass as part of a method of establishing a block cave mine or extending an existing block cave mine and an hydraulic fracturing equipment installation for carrying out the method in accordance with the invention (b) a non-metallic casing in accordance with the invention, and (c) a block cave mining method and a block cave are described with reference to the accompanying drawings, in which.

DETAILED DESCRIPTION

Figure 1:
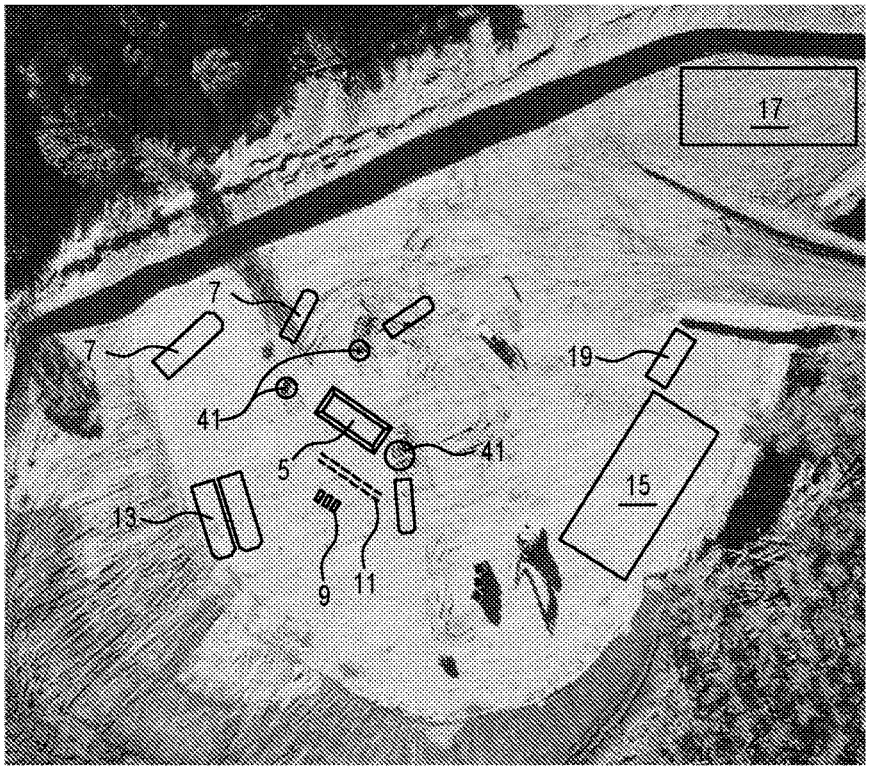
FIG. 1 is a top plan view showing a layout of an embodiment of a hydraulic fracturing equipment installation in accordance with the invention located on the ground above a rock mass and operable for hydraulic fracturing the rock mass as part of an embodiment of a method of establishing a block cave mine or extending an existing block cave mine in accordance with the invention.

FIG. 1 shows an embodiment of a hydraulic fracturing equipment installation for carrying out an embodiment of a method of hydraulic fracturing a rock mass as part of an embodiment of a method of establishing a block cave mine or extending an existing block cave mine. The installation and the method were used in a trial carried out at the Cadia mine of the applicant, discussed in more detail in a later section of the specification.

FIGS. 2-5 show an embodiment of a non-metallic casing for use in the methods and two embodiments of couplings for connecting together successive casings in end-to-end relationship.

In order to carry out the embodiment of the method of hydraulic fracturing a rock mass as part of the embodiment of the method of establishing a block cave mine or extending an existing block cave mine in accordance with the invention, it is necessary to:

(a) drill, case, and line a plurality of holes extending downwardly from a ground surface above the rock mass (stage 1) with on-the-ground drill rig equipment; and (b) perforate the cased and lined holes and pump hydraulic fracturing fluid into the holes and through perforations in the lined casings to fracture a surrounding rock mass (stage 2) with on-the-ground hydraulic fracturing equipment.

In the embodiment described below in relation to FIG. 1, the method steps in stages 1 and 2 are carried out at a number of locations within an area to be fractured in a given campaign, with each location within the area including a "cluster" of a plurality of drilled, cased, cemented, and perforated holes that are formed by drill rig equipment located at the location. FIG. 1 shows one location in the area.

The area may be any suitable sized location depending on a given mine plan. The numbers of holes in each cluster at each location may be any suitable number of holes. In the trial described below, 3 holes were drilled at a location. Typically, the number of holes will be a function of a range of factors, including required hole spacings, and the extent to which equipment for stages 1 and 2 can be positioned to drill multiple holes and to access the holes, respectively.

In the described embodiment, the drill rig equipment required for stage 1 is transported to and operated at one location, i.e. the FIG. 1 location, and then transported to another location when stage 1 is completed. Thereafter, hydraulic fracturing equipment for stage 2 is set up and operated at the FIG. 1 location and the hydraulic fracturing equipment is moved to another location at the end of stage 2.

FIG. 1 shows one location of such a cluster of holes, after stage 1 has been completed, with the holes having been drilled, cased, and lined and well heads positioned on the holes by means of the drill rig equipment, including a drill rig and accessories. The drill rig and accessories may be any suitable equipment. The drill rig equipment is not shown in FIG. 1. The drill rig equipment has already been transported to another location to drill, case, and line another cluster of holes at that location.

FIG. 1 shows the layout of hydraulic fracturing equipment at the location. The hydraulic fracturing equipment may be any suitable equipment.

The embodiment of the hydraulic fracturing equipment installation layout shown in FIG. 1, generally identified by the numeral 3, includes the following equipment:

- Crane 5 positioned to service drilled holes at the location;
- Frac van(s) 7;
- Frac pump(s) 9;
- Perforation wireline truck 11;
- Casing gun assembly (not shown);
- Micro-seismic wireline trucks (if required) 13;
- North Pond fluid storage pond 15 for hydraulic fracturing fluid;
- South Pond fluid storage 17 for hydraulic fracturing fluid;
- Wellheads 41 positioned on 3 drilled holes at the location;
- Flowback tank 19 for hydraulic fracturing fluid; and
- Hydraulic fracturing iron and flowback iron (not shown) interconnecting the well heads 41 and the fluid storage ponds 15, 17 and the flowback tank 19.

Basically, the above-mentioned equipment, including the equipment of the drill rig equipment is standard equipment that is used in the oil/gas industry and that has been adapted, i.e. modified, as required to be suitable for use drilling and lining multiple spaced-apart holes in hard rock geology in typical block cave mine locations. It is noted that the adaption of oil/gas industry equipment required knowledge and understanding of factors relevant to hard rock geology.

It is noted that the invention is not limited to the particular layout of equipment shown in FIG. 1 and other layouts may be preferred for other locations.

Figure 7:
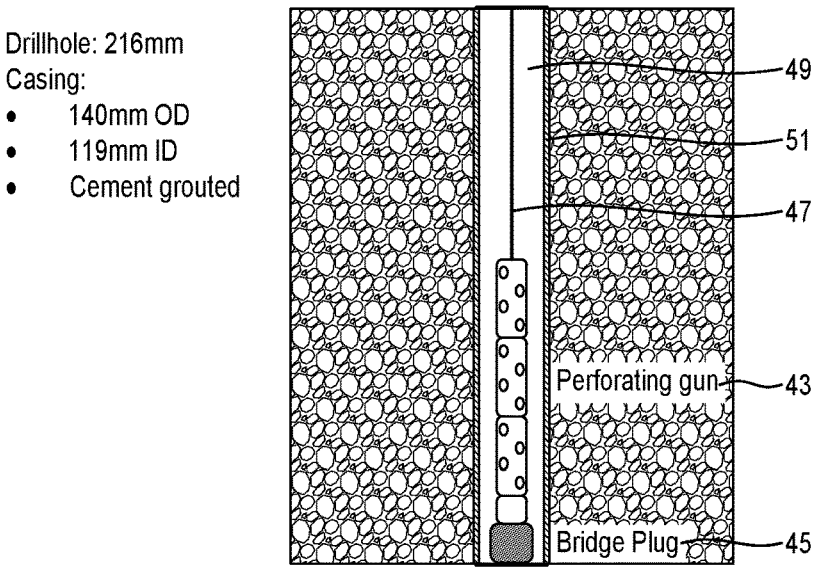
FIG. 7 is a diagrammatic cross-section showing a perforating and plugging ("Perf & Plug") tool lowered into a drill hole.
Figure 8:
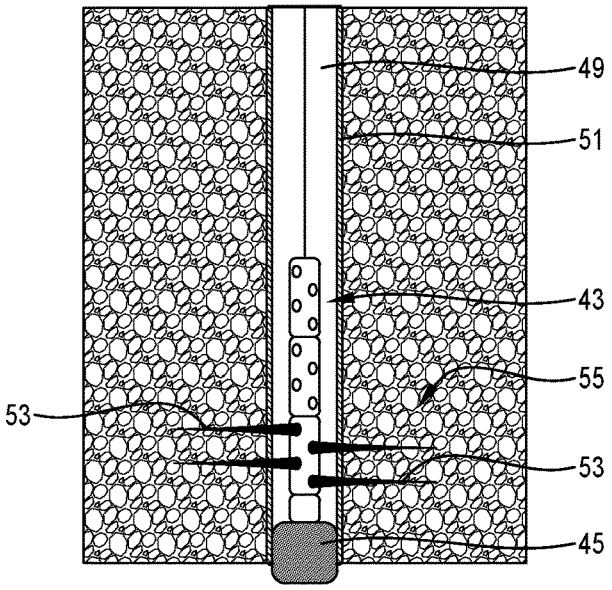
FIG. 8 is a diagrammatic cross-section showing perforations in a first perforation set in a first frac cluster created by firing shaped charges from the Perf & Plug tool shown in FIG. 7.
Figure 11:
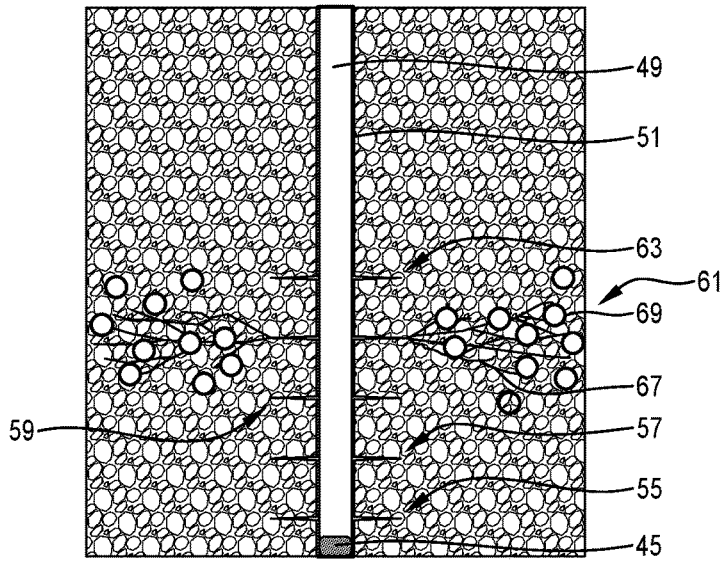
FIG. 11 is a diagrammatic cross-section showing formation of fractures propagating from perforations in a weakest perforation set of the five perforations sets in the first frac cluster and the resultant micro-seismic events.
Figure 12:
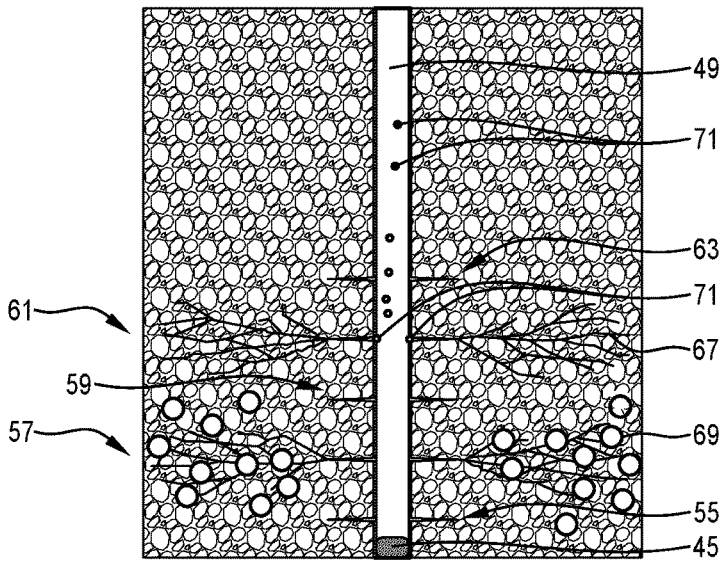
FIG. 12 is a diagrammatic cross-section showing bio-balls sealing off the weakest perforation set of the first frac cluster and allowing pressure to propagate fractures in the next weakest perforation set in the first frac cluster.

Stages 1 and 2 of the method are carried out as follows at each location in the described embodiment:

- The drill rig equipment (not shown) is mobilised and positioned at a location to drill, case, cement each hole and install a well head 41, with frac tree, in relation to each hole.
- In order to maximise efficiencies and cost, typically the drilling operation in stage 1 of the method is planned as a campaign and all of the holes required in a fracturing plan at a location are drilled and completed (i.e. cased and lined) and the drill rig equipment is demobilised and moved to another location.
- Once the drill rig equipment is demobilised, the hydraulic fracturing equipment for stage 2 is spotted and rigged up at the location as per FIG. 1.
- As part of this set-up process, hydraulic fracturing iron and flowback iron is positioned to facilitate supply of hydraulic fracturing fluid from the storage ponds 15, 17 to the well heads 41 and from the well heads 41 back to the flowback tank 19.
- At this point, equipment checks are made and each hole is subjected to a pressure test as per the Contractors Standard Operational Procedure.
- Once the necessary tests and checks have been completed, the operational sequence of the fracturing operation of stage 2 for a given cased and lined hole is as follows in the described embodiment, noting initially that the stage 2 method includes forming multiple "frac clusters" separated by bridge plugs, with each frac cluster including a selected number of "perforation sets" at different heights, with each perforation set including a selected number of perforations spaced around the perimeter of the hole:
  - Using the perforation wireline unit 11, Run in Hole (RIH) with a casing gun assembly (not shown in FIG. 1 but described as a Perf & Plug tool in FIGS. 7-12) to Plug Back Total Depth (PBTD)—see FIG. 7.
  - Tag the bottom of the hole and correlate the depth with a drilling casing tally.
  - Pull up the casing gun assembly to the first cluster depth in a first frac cluster.
  - Confirm first cluster depth, correlating with drilling casing tally.
  - Once the first frac cluster depth is confirmed, shoot the casing gun and perforate the casing at this depth and form a first perforation set with a plurality of perforations—see FIG. 8.
  - Pull up to the next perforation set depth in the first frac cluster and repeat this operation (see FIGS. 9 and 10) to form a second perforation set with a plurality of perforations and repeat this operation until all of the perforation sets in the first frac cluster have been completed.
  - Once the perforations in the required number of perforation sets in the first frac cluster are formed, Pull Out of the Hole (POOH) with casing gun assembly.
  - Once the casing gun assembly is out of the hole, commence pumping hydraulic fracturing fluid into the hole and start fracturing the rock mass proximate the weakest perforation hole set in the first frac cluster.
  - Pump fluid into the weakest perforation hole set as per an approved frac design.
  - When a specified volume of hydraulic fracturing fluid as per approved frac design has been pumped, drop perforation balls into the hole to isolate the first frac cluster—see FIG. 12.
  - The perforation balls will flow to the weakest perforation set and be drawn into the perforations with fluid flow into the perforations—and close the perforations of the weakest perforation set, the hydraulic fracturing fluid pressure will rise and the pressure drop will indicate the commencement of fracturing the rock mass proximate the next weakest perforation set in the first frac cluster.

Repeat this sequence as required and fracture all of the perforation sets in the first frac cluster.

Once the first frac cluster has been fractured, close a master valve to isolate fracturing iron and open wing valves and allow flowback from the hole to commence.

Continue the flowback operation until the well head pressure drops to 700-1000 psi.

Once the well head pressure is within this range, open a frac tree master valve and RIH with bridge plug and casing gun assembly. Lower the bridge plug and casing gun assembly to a selected depth as per approved frac design.

Pressure test the bridge plug as approved frac design.

Once the pressure test is approved, pull the casing gun assembly to the first perforation set depth in the second frac cluster.

Repeat the previous sequence until all the perforation sets in the second frac cluster are perforated and fractured.

Repeat the overall sequence until all of the planned frac clusters, with multiple perforation sets, are completed.

In general terms, the method of hydraulic fracturing the rock mass using the installation shown in FIG. 1 includes:

(a) drilling each hole in the cluster of holes at the location via the drill rig 3 positioned on the ground at the location;

(b) perforating each hole; and (c) injecting a hydraulic fracturing fluid into the holes and forcing hydraulic fracturing fluid through perforations into the rock mass and inducing, i.e. causing, fractures to form in the rock mass.

Figure 2:
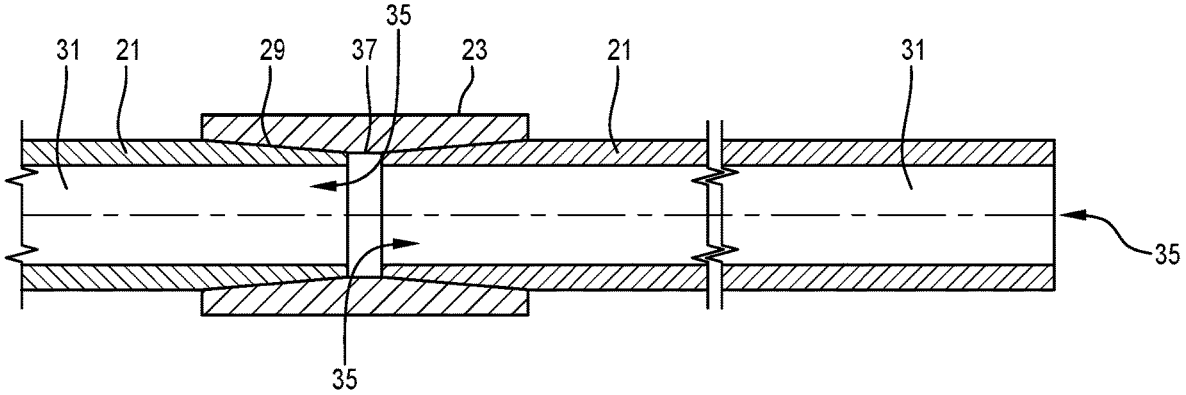
FIG. 2 is an axial cross-section of an assembly of two non-metallic casings in accordance with one embodiment of the casing of the invention connected together in end-to-end relationship via an embodiment of a coupling in accordance with the invention, with the assembly being adapted for use in a method of hydraulic fracturing a rock mass in accordance with the invention.
Figure 3:
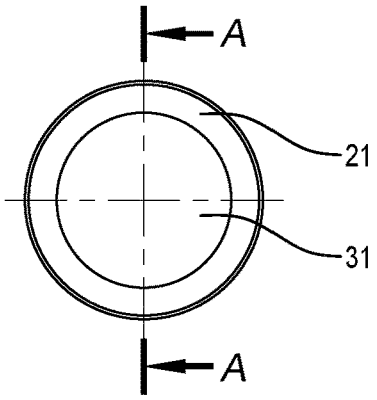
FIG. 3 is an enlarged transverse cross-section of one end section of the non-metallic casing shown in FIG. 2.
Figure 4:
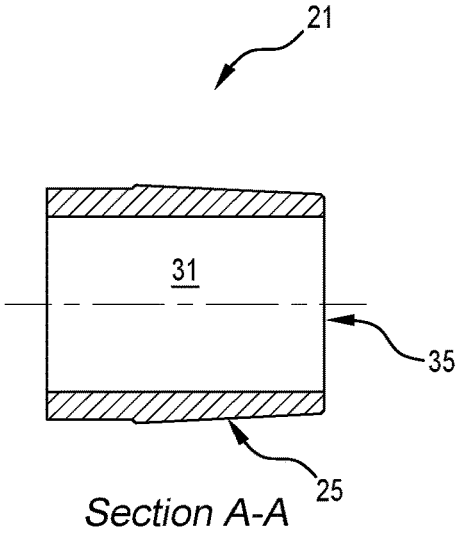
FIG. 4 is a cross-section along the line A-A in FIG. 3 which illustrates further the end section of the non-metallic casing.

In more particular terms, an embodiment of the method of hydraulic fracturing the rock mass using the installation shown in FIG. 1 includes:

(a) drilling each hole in the cluster of holes at the location via the drill rig 3 positioned on the ground at the location;

(b) lining the drilled holes with the embodiment of the non-metallic casing shown in FIGS. 2-4 or any other suitable non-metallic or metallic casing;

(d) pumping cement down the casing-lined holes to the lower ends, i.e. toes, of the holes and then up into the annular space between the hole wall and the casing to form a cement lining between the hole walls and the casings;

(e) positioning well heads 41 on the cased and lined holes;

(f) perforating successive sections of the casings and the outer cement linings with a perforating gun having spaced explosive charges that is lowered down and raised from the lined hole on a wireline (or via other suitable perforating apparatus) and (g) injecting a hydraulic fracturing fluid into the perforated casings/linings via the well heads 41 and forcing hydraulic fracturing fluid through the perforations into the rock mass and inducing, i.e. causing, fractures to form in the rock mass.

Steps (a) to (d) are stage 1 method steps and steps (e) and (f) are stage 2 method steps.

With reference to FIGS. 2-4, the embodiment of the non-metallic casing shown in the Figures is generally identified by the numeral 21 in the Figures.

With reference to FIGS. 2 and 3, the casing 21 is elongate with a central bore 31 that that has a uniform circular transverse cross-section along the casing 21 from one open end 35 to the other open end 35 of the casing 23. Each end of the casing 21 has an outer threaded end section 25.

Typically, the casing 21 is 9 m, but may be any suitable length.

The diameter of the bore 31 and the wall thickness of the casing 21 may be any suitable values depending on the performance requirements for the casing 21.

Typically, the outer diameter of the casing is at least 10 cm, but may be any suitable diameter.

The axial length of the threaded section 25 may be any suitable length.

The tapered threaded sections 25 may extend over a longitudinal distance of greater than 5 cm, typically greater than 8 cm.

The tapered threaded sections 25 may extend over a longitudinal distance of between 5 and 25 cm, typically between 8 and 15 cm.

The tapered threaded sections 25 may taper from an outer diameter of less than 15 cm, typically less than 12 cm.

The tapered threaded sections 25 may taper at an angle of between 0.5° and 2° to the longitudinal axis of the casing 21.

Figure 5:
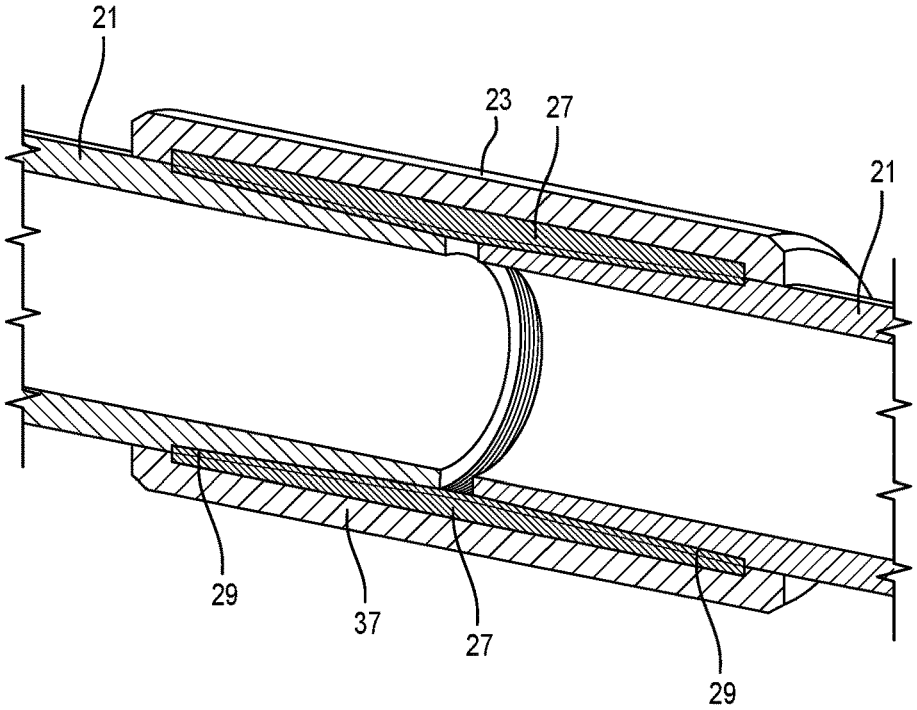
FIG. 5 is an axial cross-section similar to FIG. 1 of another assembly of two non-metallic casings in accordance with another embodiment of the casing of the invention connected together in end-to-end relationship via another embodiment of a coupling in accordance with the invention

FIG. 2 shows two casings 21 connected together in end-to-end relationship by a coupling 23. FIG. 5 shows another embodiment of a coupling 23 interconnecting two casings 21 in end-to-end relationship.

The end sections of each casing 21 and the couplings 23 in FIGS. 2-4 and in FIG. 5 are formed with complementary threaded sections that facilitate connecting together the adjacent casings 21 in end-to-end relationship.

With particular reference to FIGS. 4 and 5, the outer surface of each end section of each coupling 23 tapers inwardly towards that end 35 of the casing 23 and is formed with an external thread 29 that is complementary to the outer threaded end section 25 of each casing 21.

As can best be seen in FIGS. 2 and 5, the couplings 23 include cylindrical sleeves with open ends. The internal surfaces of the sleeves taper inwardly from the ends towards the centres, i.e. so that the internal diameters of the sleeves of both embodiments decrease inwardly from the ends of the sleeves towards the centres of the sleeves. There are flat lands 37 in respective central sections of the sleeves midway between the open ends of the sleeves. This can best be seen in the FIG. 5 embodiment of the coupling 23. The taper angles are the same angles as those for the tapered end sections of the casings 21. The internal surfaces of the sleeves are formed with threads 29. The threads 29 are complementary to the threads of the tapered end sections of the casings 21.

The couplings 23 may be formed from one material.

The couplings 23 may also be formed from different materials to optimise the performance requirements for the couplings 23. This is the case with the embodiments of the couplings 23 shown in the Figures, with the sleeves being formed from one material and the internal threaded sections being formed from other materials.

The threaded ends sections 25 are typically coated with a material such as an acetal or silicon to facilitate forming a seal with the couplings 23 when the casings 21 are located in the couplings 23.

It can readily be appreciated that, in use, a $2^{nd}$ casing 21 can be connected to a $1^{st}$ casing 21 in end-to-end relationship by the following steps:

(a) positioning one open end of the coupling 23 in alignment with an end section of the $1^{st}$ casing 21 and threading the coupling 21 onto the end section to a position shown in FIG. 2 in which the end 35 of the $1^{st}$ casing 21 is just short of the land 27; and (b) positioning the $2^{nd}$ casing 21 in axial alignment with the $1^{st}$ casing 21 and threading end section that is proximate the $1^{st}$ casing into the coupling 23 until that end of the $2^{nd}$ casing is just short of the land 27, thereby coupling together the casings 21 as shown in FIG. 2.

It is noted from FIGS. 2 and 5 that there is a small axial gap between the ends 35 of the casings 21 within the couplings 21.

The material selection for the casing 21 and the coupling 23 is an important consideration.

The casing 21 is formed from a non-metallic material having a maximum pressure resistance of 90 MPa.

In the case of the embodiment shown in FIGS. 2-4, the wall of the casing 21 is formed from a composite material comprising glass fibres in an epoxy resin matrix and the casing 21 has an internal polyethylene lining. Another suitable material for the casing wall is a composite material comprising carbon fibres in an epoxy resin matrix, again with an internal polyethylene lining.

The coupling 23 shown in FIGS. 2-4 comprises a sleeve formed from a composite material (carbon fibre reinforced epoxy resin matrix) and an internal steel threaded lining.

The applicant, via a consulting engineering company retained by the applicant, has carried out successful test work on prototype casings 21 formed from non-metallic materials mentioned above and the couplings 23 mentioned above.

The test work included pressure testing to assess whether the casings 21 and couplings 23 could survive hydraulic fracturing fluid pressures up to 10,000 psi and crush tests to assess whether the casings 21 and couplings 23 would damage mining equipment such as crushers.

The applicant has determined that non-metallic casings can be formed (a) to withstand high internal pressures, i.e. has sufficient high-pressure resistance, during injection of hydraulic fracturing fluid and (b) to fracture in a mine crusher without causing significant damage to the crusher.

Details of one particular casing 21 formed from a glass reinforced epoxy resin matrix (E-CR glass fibre and aromatic amine-cured epoxy resin) and designed to operate at an internal hydraulic fracturing fluid pressure of 10,000 psi are set out in the following Table 1.

TABLE 1

| Estimated Physical Properties<br>Estimated Physical Properties for a glass reinforced epoxy resin matrix (E-CR glass fibre and aromatic amine-cured epoxy resin) | |
|---|---|
| Outside diameter "A" (in) | 5.3 |
| Bore "B" (in) | 4.0 |
| Coupling diameter "C" (in) | 6.7 |
| Casing joint length (m) | 8.5 |
| Linear mass (ppf) | 6.6 |
| Internal operating pressure (psi) | 10,000 |
| Internal burst pressure (psi) | >15,000 |
| External collapse pressure (psi) | 5,000 |
| Tensile strength (klbf) | 250 |
| Compressive strength (klbf) | 250 |
| Axial stiffness EA (klbf) | 2,000 |
| Bending stiffness EI (klbf $ft^s$) | 400 |
| Minimum midbody bend radius (ft) | 50 |
| Make-up torque (ft-lbf) | 1,000 |
| Torsional stiffness GJ (klbf $ft^2$) | 150 |
| Torsional strength (ft-lbf) | 5,000 |
| Maximum temperature (° C.) | 60 |
| Density (specific gravity) | 1.7 |

The test work carried out to date has indicated that it is possible to operate successfully with non-metallic casings 21.

The applicant has completed a confidential trial of an embodiment of a method of hydraulic fracturing a rock mass and an embodiment of a hydraulic fracturing equipment installation in accordance with the invention at the Cadia mine of the applicant in New South Wales, Australia.

The trial results greatly exceeded expectations.

Logistically, the trial achieved much faster drilling, more fractures per shift, and much more volume pre-conditioned, i.e. fractured, when compared to the current underground hydraulic fracturing methods.

By way of context, as noted above, the primary purpose of hydraulic fracturing applied at Cadia to date has been to reduce the risk of seismicity by creating more fractures in competent rock. Hydraulic fracturing is seen as one of the most effective techniques to decrease seismic risk during the mine development phase and during cave operations. Current practice at Cadia is to drill and fracture from underground. This is consistent with established underground mining industry practice.

The background lithology at the Cadia mine is volcanoclastic to andesitic volcanics. Three major structure groups occur near to the trial site: Carbonate Fault 5, Sericite-Chlorite-Clay shears and Cadia East Intrusive Dykes. Basically, the lithology is hard and abrasive. Volcaniclastics averaged 133 MPa, with the upper end of the range being 269 MPa. The silica content of 60.7% meant that there was a high abrasivity index. The Cadia conditions were seen as extreme by the drill bit suppliers and the drilling consultant retained by the applicant for the trial.

The hydraulic fracturing equipment installation for the trial was as described above in relation to FIG. 1. FIG. 1 shows the layout, with 3 wellheads 41 on the drilled holes.

The scope of the trial was as follows:

- Design and engineering of drilling and hydraulic fracturing programs.
- Earthworks for drill pads.
- Establish services at drill pads.
- Drill 4×1,550 m depth drill holes: 2×Vertical and 2×directionally drilled.
- Case the four drill holes with high pressure steel casing and cement in place.
- Install high pressure wellheads.
- Install temporary water storage ponds.
- Hydraulically fracture the bottom 180 m of each drill hole using plug and perforation (Plug & Perf) technology:
  - Target 100 m radius and with a 4 m fracture spacing.
  - Trial fracture spacings of 2 m and 1 m in specific sections.
- Real-time monitoring of induced seismicity using a micro-seismic system
- Analyze seismic data and evaluate achieved results
- In parallel, develop a non-steel drill hole casing.

Key parameters of the trial are set out below in Table 2.

TABLE 2

| Project Data | |
|---|---|
| Items | Quantity |
| Earthworks ($m^3$) | 70,000 |
| Drill pads | 8,150 $m^2$ |
| Drill holes | 3 |
| Drilled metres | 4,632 |
| Drilling rate of penetration 12-¼" diam. (m/hr) | 9.5 |

TABLE 2-continued

| Project Data | |
|---|---|
| Items | Quantity |
| Drilling rate of Penetration 8-½" diam. (m/hr) | 6.1 |
| Overall drilling RoP (m/hr) | 6.3 |
| Drill hole duration per hole (days) | 20-22 |
| Casing (m) | 5,232 |
| Drill bits (8-½") | 21 |
| Fracture radius (m) | 160-170 |
| Number of fracs | 129 |
| Vertical metres preconditioned | 590 |
| Volume of rock preconditioned (million $m^3$) | 38.6 |

Figure 6:
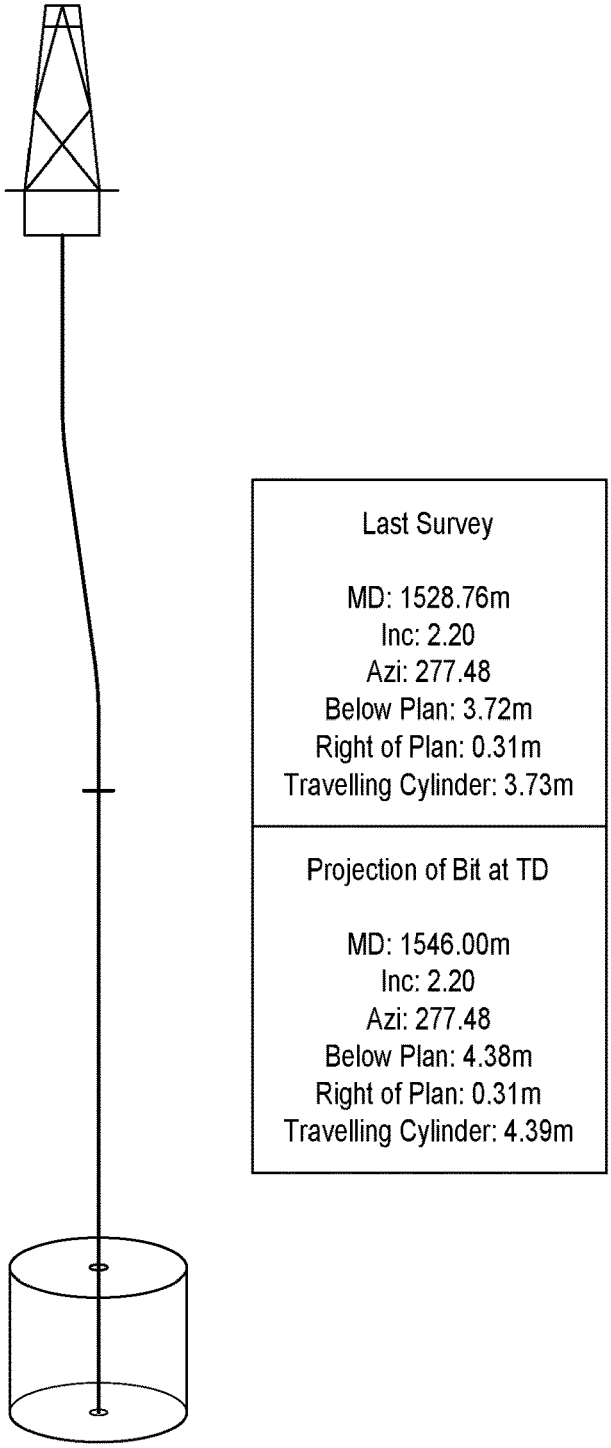
FIG. 6 is a final survey of drill hole RE006 drilled in a trial conducted by the applicant.

The trial completed 3 of the 4 planned holes, with drilled hole details as follows:

The first drill hole RE006 was 1,546 m depth and surveyed within 4.4 m of target. FIG. 6 is a final survey of the drill hole.

Drill hole RE008 was 1,557 m and was surveyed within 3 m of target.

Drill hole RE007 was the third and final drill hole was drilled to a depth of 1,517 m and used a total of 7.5 drill bits.

The fourth planned hole was not drilled because the results with the preceding three holes were positive and a decision was made by the project team that the fourth hole was not required.

In addition, each of the three drilled holes was drilled using directional drilling technology.

Before the commencement of the trial, the project team identified a list of main project risks and assessed the outcomes versus these risks at the completion of the trial. Table 3 summarises the technical risks and outcomes.

TABLE 3

| Main Project Risks and eventual outcomes | |
|---|---|
| Risk description | Did the risk eventuate? |
| 1 Partial or total fluid losses resulting in delays to the drilling schedule or drill string losses | No fluid losses due to surface weathered rocks, Silurian sediments, fault zones, structures or lithology changes. |
| 2 Drilling rate of penetration (RoP) slower than planned, especially in volcanics | The estimated rates in the planning stage were: 20 m/hr in sediments and 5 m/hr in volcanics. Actual average RoP achieved for each drill hole:<br>RE006:<br>7.6 m/hr in sediments<br>4.7 m/hr in volcanics<br>RE008:<br>11.4 m/hr in sediments<br>7.1 m/hr in volcanics<br>RE007:<br>9.4 m/hr in sediments<br>5.6 m/hr in volcanics<br>The RoP achieved in the sediments was not ¼" section was drilled in 1-1.5 days for each hole.<br>The average RoP achieved in the volcanics was better than planned.<br>On the first hole, RE006, the initial drilling parameters were conservative due to the perceived risk of fluid losses and variable rock conditions. Hence the actual RoP was below estimated. The learnings from RE006 were immediately applied to the next holes in terms of drill bit selection and BHA combinations. As a result, the overall RoP was improved along with the reduced number of bits used. |
| 3 Surface hydraulic fracturing does not create fracs to the planned 100 m radius extents. | The fractures achieved exceeded the minimum 100 m, reaching as far as 170 m radius based on the seismicity recorded. These results exceeded expectations. The risk did not eventuate. |

Directional drilling was recognised by the project team as an important drilling option for the trial to ensure accurate drilling in order to steer around existing underground openings and to hit the target hydraulic fracturing zones.

The actual versus drilled paths were an excellent result on all three drill holes and a significant finding for what can be achieved through directional drilling.

The ability to steer around existing or planned underground openings or to avoid unfavorable structures or lithology opens opportunities compared to conventional rotary or diamond drilling.

The first drill hole RE006 was used as an initial trial to determine what drill bits may work across certain rock types. The three main types of drill bit used on RE006 were:

a. PDC: Pol-crystalline diamond composite b. TCI: Tungsten Carbide Insert bit arranged as a Tri-cone c. Hybrid: Combination of PDC and TCI A total of nine bits were used on RE006.

The information gained was invaluable and allowed much better bit selection aligned to hole depth intervals and rock types for the subsequent drill holes.

By the end of the third hole RE007, the project team was confident that it had achieved a drilling "recipe" of key learnings that combined the proven oil/gas industry downhole equipment (drill bits, downhole motor, collars, stabilisers, etc) along with the operating parameters (torque, weight on bit, pumping rate, drilling fluids, etc) that could be applied on future hydraulic fracturing programs. Therefore, as noted above, the project team decided that the fourth planned hole was not required.

After drilling, casing and lining the holes, the next stage in the trial involved hydraulic fracturing each hole.

The hydraulic fracturing steps for each hole comprised forming 5 frac clusters along a section of the hole, with each cluster comprising multiple perforation sets spaced apart by 4 m, with each perforation set comprising multiple perforations around the perimeter of the hole at that height.

It is noted that the invention is not confined to this number of frac clusters and perforation sets and spacings between the sets. For example, there may be more or fewer frac clusters and different numbers of perforation sets per frac cluster and different spacings between perforation sets and different numbers and sizes of perforations in each perforation set. The particular selection made for the trial was based on carrying out sufficient hydraulic fracturing to test the method.

A wireline crew used a truck-mounted winch to lower tools downhole and control these tools via signal cable (the wireline). The tools included perforating guns incorporating explosive charges and bridge plugs to seal off sections of drilled, cased and lined holes.

A fracturing crew was responsible for operating a high-pressure pumping system and associated treating iron and valving in order to provide up to 140 MPa fracturing pressure at flow rates up to 20 barrels per minute (53 litres per sec) into drilled, cased and lined holes.

The "Plug & Perf" procedure was based on oil and gas industry technology. Perforations were created in the drill hole cased and lined walls using shaped explosive charges at 4 m spaced intervals.

The explosive charges were arranged in a perforating gun on the surface, then lowered to specific depths on a wireline system. The gun also included a 10,000 psi-rated plug which was used to seal off the previously-treated section of the hole below. In this way, only a 20 m section of drill hole was preconditioned at a time (One stage=5×4 m spaced fracs).

The "Plug & Perf" procedure is illustrated in FIGS. 7, 8, 9, 10, 11, and 12, described below in the context of forming a first of five planned frac clusters of perforation sets, with each set of each frac cluster being spaced apart by 4 m:

FIG. 7: A perforating gun 43 and bridge plug 45 are shown lowered via a wireline 47 into the cased and lined drilled hole 49, with the lined casing shown by the numeral 51.

FIG. 8: The bridge plug 45 was expanded to close the drilled hole 49 at the location of the bridge plug 45 and was tested in accordance with established procedures. Perforations 53 in a first perforation set 55 of the first frac cluster in the cased and lined drill hole were then created by firing shaped charges housed by the perforating gun. Charges were initiated from the surface via the wireline 47 in a set of four, arranged at 90° spacing. The perforations were 10 mm diameter and penetrate the surrounding rock by around 200 mm.

Figure 9:
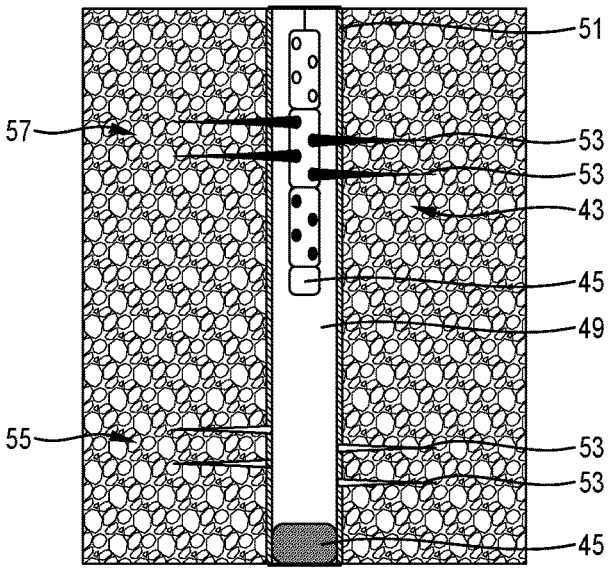
FIG. 9 is a diagrammatic cross-section showing perforations in a second perforation set in the first frac cluster created by firing shaped charges from the Perf & Plug tool shown in FIG. 7 after raising the perf gun 4 m from the location shown in FIG. 8.

FIG. 9: On the completion of this step, the perforating gun 43 was moved upwardly by 4 m to fire the next set of perforations 53 in a second perforation set 57 of the first frac cluster. The gun 43 was then raised up 4 m and the next set of perforations (not shown) in the first frac cluster was fired. The openings created provided the initial path for the fracturing fluid to follow in the next step: Pumping.

Figure 10:
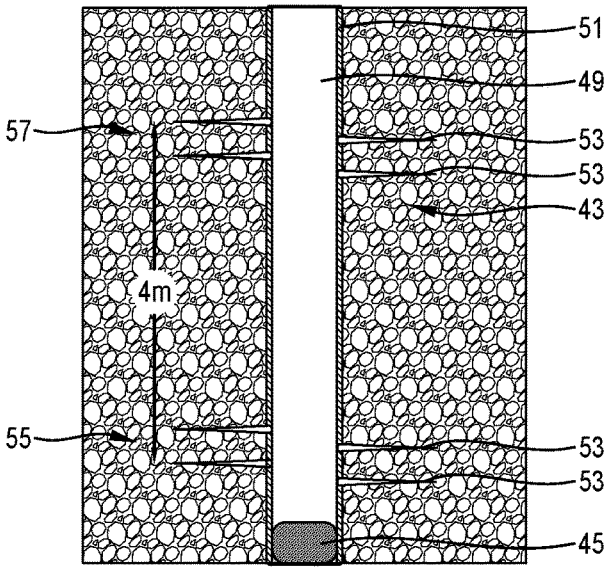
FIG. 10 is a diagrammatic cross-section showing the first and second perforation sets in the first frac cluster created by firing charges at 4 m spacing, ready for pumping stage.

FIG. 10: The Figure shows two perforation sets 55, 57 in the first frac cluster created by firing charges at 4 m spacing, ready for the pumping stage.

This procedure was repeated to form 5 perforation sets (see FIG. 11-55, 57, 59, 61, 63) for the first frac cluster.

At this point, the perforating gun 43 was removed to surface and the whole casing was pressurised down to the lowest bridge plug using high pressure pumps.

Two, 1,600 kW diesel-powered pumps (not shown) were located at the surface for this purpose. Each pump could deliver 3,000 litres per minute at up to a maximum 100 MPa (15,000 psi) pressure at the surface.

A 100 MPa rated "Frac Head" was then installed on each drilled hole enabling controlled application of flows and pressures within a contained system.

FIG. 11 is a schematic section showing the formation of fractures 67 propagating from perforations in perforation set 61 and the resultant micro-seismic events. This perforation set 61 was the weakest of the perforation sets 55, 57, 59, 61, 63 in the first frac cluster. The fractures 67 deformed the rock and as a result, micro-seismic events occurred. These micro-seismic events are illustrated in FIG. 11 by the small balls 69 proximate the fracture lines. As the pressure increased, the pumped water.

After a calculated duration of flow at a set flowrate, small plastic 'bio-balls' 71 (see FIG. 12) were released from a ball dropper at the surface. These bio-balls 71 sunk through the water at a set velocity and reached the weakest perforation set. The flow into the already-formed fractures was enough to draw the balls into the 10 mm perforations and hence seal off the perforation set 61.

FIG. 12 shows bio-balls 71 sealing off the perforation set 61, thereby allowing hydraulic fluid pressure to build up and start to propagate fractures at the next weakest perforation set 57 in the first frac cluster. The second set of fractures propagated from the perforation holes in this set 57, as described above in relation to the perforation set 61.

A second set of balls 71 was dropped and was drawn into and closed the perforations in the perforation set 61, and the process was repeated until the five×perforation sets 55, 57, 59, 61, 63 in the first frac cluster were fractured across the 20 m high section of the first frac cluster.

The actual downhole pressures achieved during the trial reached around 138 MPa (or 20,000 psi).

When hydraulic fracturing the first frac cluster was completed, the master valve was closed to isolate fracturing iron and wing valves were opened to allow flowback of hydraulic fluid from the hole to commence. Flowback continued until the well head pressure dropped to 700-1000 psi. Once the well head pressure was within this range, the frac tree master valve was opened and a RIH with bridge plug and casing gun assembly was lowered to a desired depth as per approved frac design and the bridge plug was expanded as described above in relation to the first frac cluster.

The procedure described above in relation to perforating and hydraulic fracturing the first frac cluster was repeated for the second frac cluster.

The above-described perforating and hydraulic fracturing the first and second frac clusters was repeated to form each of the five frac clusters.

An external contractor provided a seismic monitoring service at site and processed the results. The main activities of the contractor included:

Cement bond logging of each hole.

Vertical seismic profile.

Install and run Versatile Seismic Imager (VSI) downhole tools (each tool included 8×geophones).

Record perforation shots as calibration.

Monitor the hydraulic fracturing stimulation in each hole.

Perform VSI synchronization using a Vibroseis unit during and at the end of each drill hole.

The process followed by the contractor on each drill hole was as follows:

i. Record perforation shots in the drill hole to be fractured.

ii. Start HFM recording 10-30 minutes prior to stimulation on both VSI units.

iii. Record each stage of perforation and stimulation.

iv. After half of the stimulation was completed, perform mid-job VSI synchronisation by using the Vibroseis unit v. Complete HFM operation and record for additional 30 minutes vi. At conclusion of the HFM operation perform, end of job VSI synchronisation.

vii. Rig down one of the VSI tool strings and move to next drill hole.

The contractor generated considerable data in real time and for later processing and evaluation. The data indicated that the trial was a success. There was successful hydraulic fracturing in a controlled pattern, with the results exceeding expectations.

Figure 13:
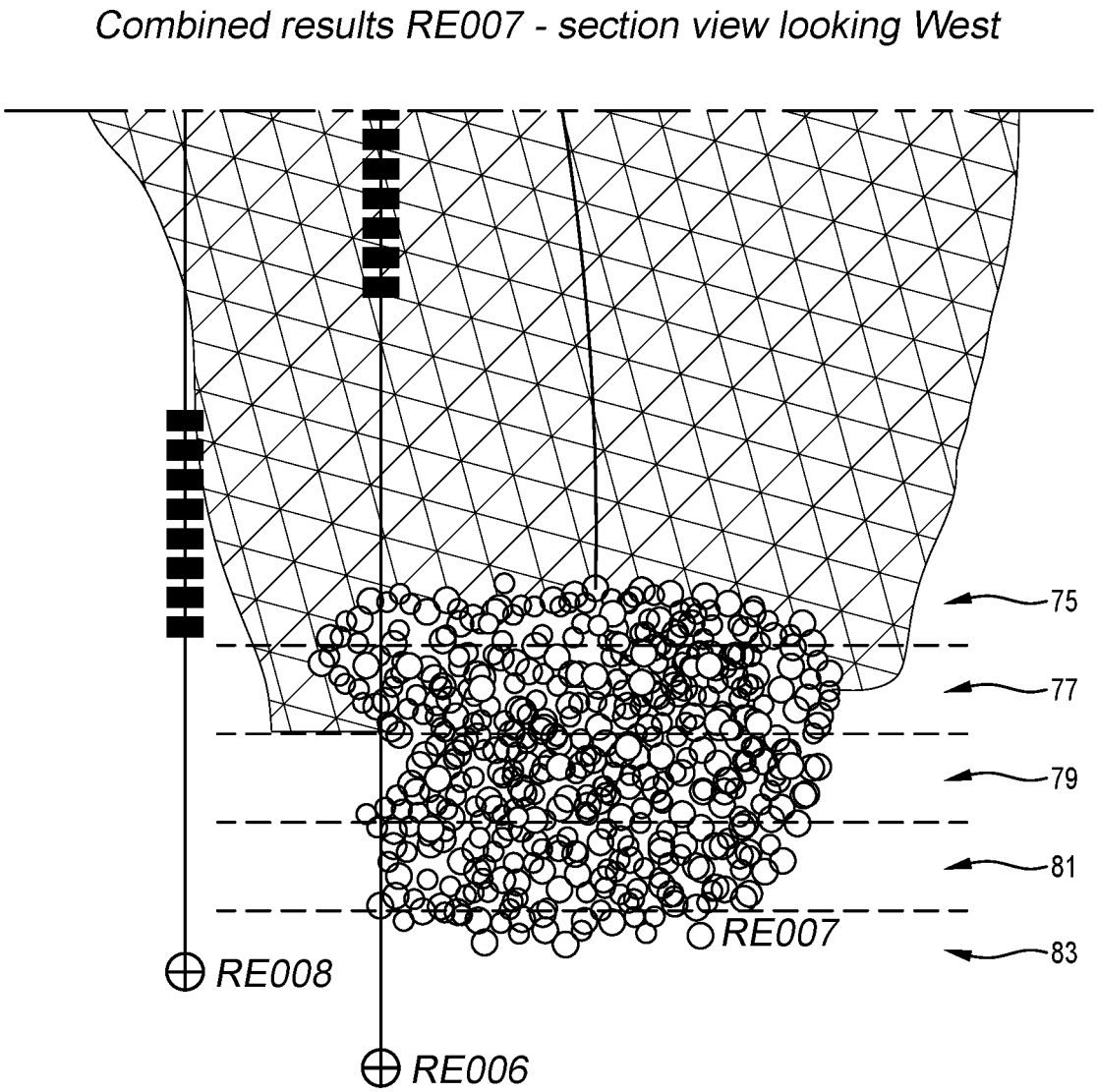
FIG. 13 is a cross-section image that shows the combined results for drilled hole RE007—with the section viewed looking West.

The combined results of seismic processing for one of the drilled holes, namely drill hole RE007, are shown in FIG. 13.

The Figure shows the volume of rock stimulated by the hydraulic fracturing at each pumping stage. The different regions 75, 77, 79, 81, 83 in the Figure show the results of fracturing each of the five clusters of five perforation sets.

The Figure shows that the zone pre-conditioned during the trial far exceeded the planned dimensions of a cylinder with radius 100 m. This is a positive result.

The overall volume pre-conditioned is the key parameter, rather than measuring individual fracture radius. The Figure shows that hydraulic fracturing when applied in an underground hard rock environment does not create a singular flat fracture as a disc emanating from a drill hole but rather a cloud of multiple fractures with a vertical extent of between 30-40 m at each frac stage.

When the multiple in-situ structures, joints, infills and other discontinuities that are known to exist in the Cadia orebody are taken into account, this outcome of a wide zone of seismicity with events appearing at different times and not always radiating outwards from the source perforations would follow the anisotropic nature of the rock mass.

Many modifications may be made to the embodiments of the invention described in relation to the Figures without departing from the spirit and scope of the invention.

By way of example, whilst the embodiment of the invention described in relation to the Figures include forming a plurality of holes as a cluster at one location and hydraulic fracturing the holes at that location, the present invention is not limited to this embodiment and extends to embodiments in which a single hole is drilled and hydraulically-fractured at one location and this process is repeated at each successive location.

The invention claimed is:

1. A method of hydraulic fracturing a rock mass as part of a process for establishing a block cave mine or extending an existing block cave mine, the method comprising:

(a) drilling a plurality of holes downwardly into the rock mass using above-ground drill rig equipment positioned above a proposed or existing block cave mine, and casing and lining each hole to form a plurality of cased-and-lined holes; and (b) perforating each cased-and-lined hole to form a plurality of cased-and-lined-and-perforated holes, and injecting a hydraulic fracturing fluid into the cased-and-lined-and-perforated holes from above-ground hydraulic fracturing equipment so that the hydraulic fracturing fluid flows through perforations in the plurality of cased-and-lined-and-perforated holes into the rock mass and induces fractures in the rock mass.

2. The method of claim 1, wherein casing and lining each hole to form the plurality of cased-and-lined holes comprises lining each hole with a non-metallic casing comprising a non-metallic material having a maximum pressure resistance of 90 MPa.

3. The method of claim 2, wherein the non-metallic material comprises a fibre-reinforced composite material.

4. A method of hydraulic fracturing a rock mass as part of a process for establishing a block cave mine or extending an existing block cave mine, the method comprising:

(a) drilling a first hole downwardly into the rock mass using drill rig equipment positioned on ground at a location;

(b) lining the drilled hole with a casing and forming a cased hole;

(c) pumping cement or any other suitable lining material down the cased hole to a lower end of the cased hole and then up into an annular space between a hole wall and the casing to form a cased-and-lined hole with a lining between the hole wall and the casing;

(d) positioning a well head on the cased-and-lined hole;

(e) perforating the casing and the outer lining of the cased-and-lined hole at spaced intervals along a section of the drilled hole with a perforating apparatus and forming a cased-and-lined-and-perforated hole;

(f) injecting a hydraulic fracturing fluid into the cased-and-lined-and-perforated hole via the well head and forcing hydraulic fracturing fluid through perforations into the rock mass and inducing fractures in the rock mass; and (g) carrying out (a) to (f) for each of a plurality of additional holes.

5. The method defined in claim 4, comprising drilling each of the plurality of additional holes and carrying out (b) through (f) on each of the additional holes at the location and forming a cluster of holes that includes the first hole and the additional holes at the location and forming induced fractures in the rock mass by injecting the hydraulic fracturing fluid into the additional holes at the location.

6. The method defined in claim 5, further comprising carrying out (a) to (d) as stage 1 method steps for each of the additional holes with drill rig equipment at the location and forming the cluster of holes and then, on completion of the stage 1 method steps, moving the drill rig equipment to another location and repeating the stage 1 method steps with the drill rig equipment at the other location.

7. The method defined in claim 6, further comprising setting up hydraulic fracturing equipment at the location after the drill rig equipment has been moved from the location and perforating each of the additional holes in the cluster and hydraulic fracturing the holes in accordance (e) and (f) as stage 2 method steps and then, on completion of the stage 2 method steps, moving the hydraulic fracturing fluid injection equipment to another location and repeating the stage 2 method steps at the other location.

8. A hydraulic fracturing equipment installation positioned at a selected location on ground above a rock mass and operable for hydraulic fracturing the rock mass by the method according to claim 7 as part of a process for establishing a block cave mine or extending an existing block cave mine, the hydraulic fracturing equipment installation including:

(a) movable drill rig equipment positioned at the selected location on the ground above the block cave mine being established or extended and operable to carry out the stage 1 method steps to form the cluster of holes at the location and movable to another location at the completion of the stage 1 method steps; and (b) hydraulic fracturing equipment located on the ground at the location after the drill rig equipment has been moved from the location and operable for perforating the holes and injecting hydraulic fracturing fluid into the holes for inducing fractures in the rock mass in the stage 2 method steps and movable to another location at the completion of the stage 2 method steps.

9. The installation defined in claim 8, wherein the drill rig equipment includes equipment operable for lining the drilled holes with a casing.

10. The installation defined in claim 9, wherein the drill rig equipment includes equipment operable for forming a lining in an annular space between the casing and a hole wall.

11. A block cave mine comprising a hydraulic fracturing equipment installation defined in claim 10, the hydraulic fracturing equipment installation being located on ground above a rock mass at a block mine establishment stage or an extension stage of an existing block cave mine and being operable for hydraulic fracturing the rock mass in the process for establishing the block cave mine or extending the existing block cave mine.

* * * * *